United States Patent [19]

Marker et al.

[11] 3,998,474

[45] Dec. 21, 1976

[54] SAFETY SKI-BINDING

[75] Inventors: Hannes Marker, Garmisch-Partenkirchen; Heinz Hörnschemeyer, Oberammergau, both of Germany

[73] Assignee: Hannes Marker, Germany

[22] Filed: Apr. 16, 1975

[21] Appl. No.: 568,527

[30] Foreign Application Priority Data

Apr. 24, 1974 Germany ..... 2419326

[52] U.S. Cl. ..... 280/618; 280/637

[51] Int. Cl.[2] ..... A63C 9/086

[58] Field of Search ..... 280/11.35 N, 11.35 T, 280/11.35 R, 11.35 K, 11.35 C, 11.35 F, 637, 618, 613

[56] References Cited

UNITED STATES PATENTS

| | | | |
|---|---|---|---|
| 3,740,064 | 6/1973 | Weg | 280/11.35 T |
| 3,822,070 | 7/1974 | Salomon | 280/11.35 N |
| 3,825,274 | 7/1974 | Weinstein | 280/11.35 N |
| 3,844,575 | 10/1974 | Salomon | 280/11.35 N |
| 3,871,674 | 3/1975 | Bunn, Jr. | 280/11.35 N |
| 3,893,682 | 7/1975 | Weinstein | 280/11.35 N |

FOREIGN PATENTS OR APPLICATIONS

| | | | |
|---|---|---|---|
| 227,994 | 7/1943 | Switzerland | 280/11.35 N |

*Primary Examiner*—M. H. Wood, Jr.
*Assistant Examiner*—David M. Mitchell
*Attorney, Agent, or Firm*—Fleit & Jacobson

[57] ABSTRACT

In a safety ski-binding for connecting a ski boot directly to a ski or over a sole plate of the ski by means of an extensible cable near each of the front and back of the boot, extension of the cable being resiliently opposed by the spring of a cable drum and the cable being only deliberately detachable from the boot or sole plate, the boot or sole plate is held to the ski against vertical as well as horizontal motion by two latching devices each comprising a catch member on the ski or on the boot or sole plate and a latch member movable with respect to the catch member and biased into engagement therewith by the cable.

7 Claims, 6 Drawing Figures

SAFETY SKI-BINDING

The present invention relates to safety ski-bindings which connect a ski boot to a ski, either directly or indirectly by way of a sole plate, by means of a cable control engaging near each of the front and back of the sole of the boot, wherein each cable control can be pulled out to a limited extent against the action of a spring force and can only deliberately be released from the boot or sole plate, respectively, and wherein the boot or sole plate is, under normal operating conditions, secured on the ski against horizontal motion by at least one latching mechanism.

Such a safety ski-binding, in which the cable controls engage fittings that are fixed to the sole of the boot, is shown for example in German Specification No. 2,156,936. Another and even older safety ski-binding of this kind, which has likewise only been disclosed on paper and wherein a sole plate is provided for the ski boot, is disclosed for example in Austrian Specification No. 211,203.

These safety ski-bindings prevent the unintentional complete detachment of the boot from the ski. After there has been relative motion between the boot and the ski as a result of excessive load which does not only have a shock or impact effect, the spring force ensures automatic resetting. The characteristic of the spring necessitates an increase in the spring force with increasing movement of the boot relatively to the ski.

The safety of a skier during a fall necessitates a certain minimum length by which the cable controls can be pulled out and thus there are two opposing requirements, namely a sufficient length by which the cable can be pulled out and the retaining force that is necessary during skiing for transmitting steering forces and for taking up impacts.

In the embodiment according to the said Austrian Specification, these requirements are not fulfilled or fulfilled only inadequately, which explains why this particular binding has not found practical success.

In the embodiment according to the aforementioned German specification, however, the requirements are met more satisfactorily, at least from a theoretical point of view. This is achieved in that each cable control is under the influence of a spiral spring disposed coaxially with the associated cable drum and acting thereon, the spring being relatively weak, and in that a second stronger spring in the form of a wound spiral spring influences the cable drum within a so-called range of elasticity. As a result of this, only the weak spiral spring acts on the boot in the sense of pulling the cable back if the boot has moved beyond the range of elasticity with respect to the ski. As soon as the boot and ski have been pulled together again to a sufficient extent, the relaxation of the stronger spring takes effect and returns the boot and ski to their normal position relatively to one another.

This embodiment of safety ski-binding according to German Specification No. 2,156,936 nevertheless exhibits certain disadvantages that detract from its utility. First of all the two latching devices that are provided are not able to provide relative rotation between the boot and the ski when there is a strictly rotary load of appropriate size, because the latching devices do not comprise a movable element as is usually the case with other known latching devices. Further, this safety ski-binding requires a larger number of parts because two substantially successively operative spring systems are required. This makes the manufacture more expensive and the device as a whole more liable to faults. Again, this ski-binding has not been used in practise.

It is an object of the present invention to improve a safety ski-binding of the aforementioned kind so that it will meet the previously discussed requirements and yet be simple and cheap to make and reliable in operation.

According to the invention, there is provided a safety ski-binding which connects a ski boot to a ski, either directly or indirectly by way of a sole plate, by means of a cable control engaging near each of the front and back of the sole of the boot, wherein each cable control can be pulled out to a limited extent against the action of a spring force and can only deliberately be released from the boot or sole plate, respectively, and wherein the boot or sole plate is, under normal operating conditions, secured on the ski against horizontal motion by at least one latching mechanism, characterised in that two latching devices are provided which additionally secure the boot or sole plate against vertical motion and each comprise a catch member fixed either to the ski or to the boot or the sole plate and a latch member which is movable with respect to the catch member and is mounted on or in the part engaged by the extensible spring-loaded end of the cable control, that the cable control biases the latch member to the latching position, and that the latch member carries a pulley over which the cable of each control passes to the fixed anchoring point.

This construction permits, inter alia, a secure and purely rotational or translatory movement of the boot or sole plate on the ski when there is a correspondingly high torsional load. In addition, the safety ski-binding according to the invention requires only one spring system at each of the front and back.

The movable latch member of the latching device may be in the form of a slide member. It could also be in the form of a latching lever, in which case it is preferably formed by the shorter arm of a bell crank lever, the cable being guided along both arms, each of which carries at least one pulley. It is advantageous if the pulley of the longer arm is adjustable therealong, thereby providing a simple form of adjustability for the releasing force of the latching device.

Examples of the invention will now be described with reference to the accompanying drawings, wherein.

Figures 1, 2, 3:
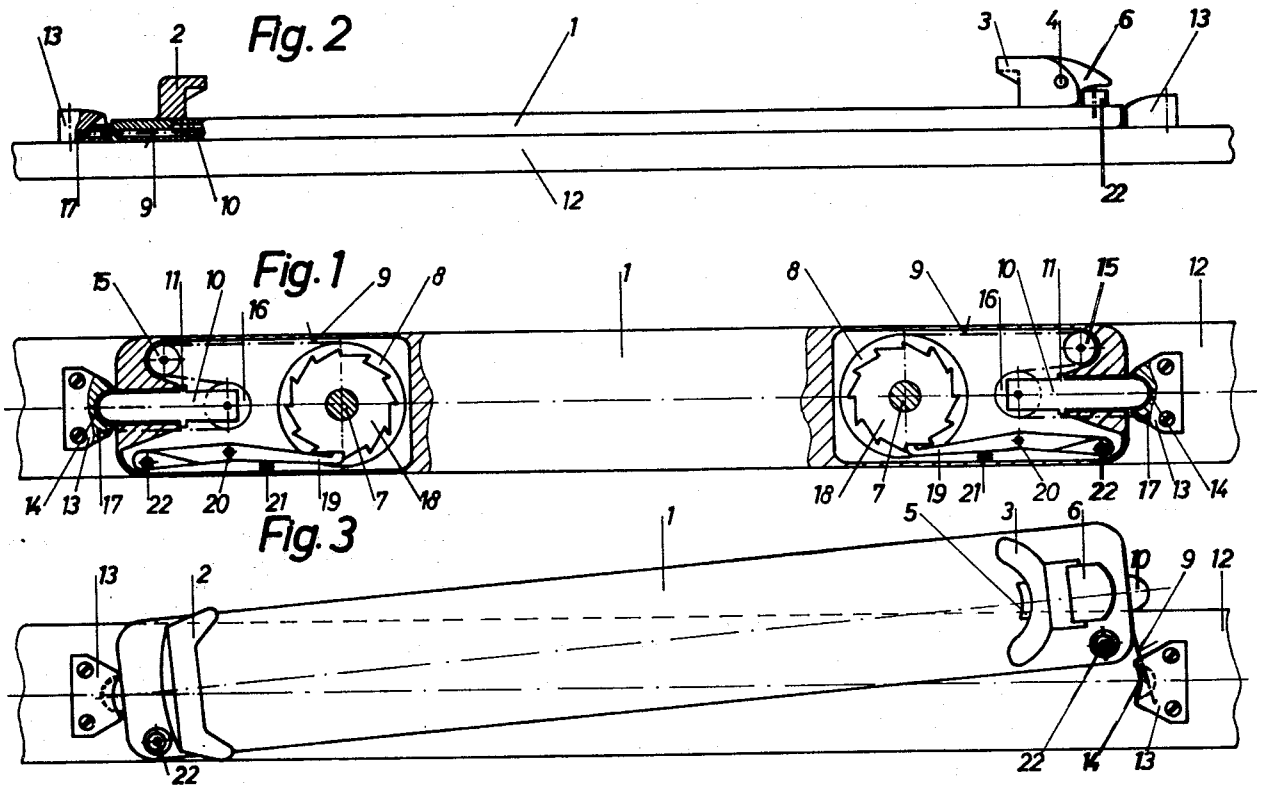
FIG. 1 is a part-sectional plan view of a first embodiment of safety ski-binding.
FIG. 2 is a side elevation of the binding according to FIG. 1.
FIG. 3 is a plan view of the same binding showing the sole plate pivoted to a lateral position.

The safety ski-binding shown in FIGS. 1 to 3 is a so-called plate binding. The sole plate 1 carries a sole holder 2 at one end for receiving and securely holding the tip of the ski boot. At its other end, the sole plate carries a sole holder 3 which is pivotable about a horizontal transverse axis 4 relatively to the sole plate. Fixed to the sole holder 3 there is a pedal 5 (see FIG. 3) so that, after the front end of the sole of the boot has been introduced into the sole holder 2, the rear end of the sole of the boot can automatically swing to its locking position as the boot is depressed during the stepping-in procedure. The sole holder 3 can now only be deliberately moved from its locking to its open position, for example by actuating an opening handle 6.

Two cable controls or tackles are provided in the sole plate 1, as is best shown in FIG. 1. The two cable controls are mirror images of one another and consequently the same reference numerals have been employed for both controls and it will be necessary to describe only one of them. Mounted in the sole plate on a vertical shaft 7 there is a cable drum 8. This drum is subjected to the influence of a spiral spring such as that known from German Specification No. 2,156,936. Since the spiral spring is known per se, it need not be described in further detail and it has been omitted from the drawing for clarity. It suffices to say that this spring biases the cable drum 8 in the sense of keeping the cable 9 wound up on the drum.

Each cable control includes a slide latch member 10 which is mounted for longitudinal displacement within the sole plate 1 and an operative end of which projects from the end of the sole plate. To limit the amount of movement of the slide latch member 10 in the projected or outward direction, it is provided with abutments 11. Adjacent each end of the sole plate 1 and screwed to the top of the ski 12 there is a fitting 13 containing a catch groove 14 for co-operating with the respective slide latch member 10.

The cable 9 of each cable control or tackle extends from the cable drum 8, over pulleys 15, 16 to a fixed anchoring point 17 on the fitting 13. Whereas the pulley 15 is rotatably mounted in the sole plate 1, the pulley 16 is mounted at the inner end of the slide latch member 10.

Fixed to the cable drum 8 there is a ratchet wheel 18 of a retaining device, of which the pawl 19 is mounted on a vertical shaft 20 in the sole plate 1. The pawl is in the form of a bell crank lever and is under the influence of a retaining spring 21 which normally holds the operative end of the pawl in engagement with the ratchet wheel 18. Also disposed in the sole plate 1 there is a push button 22 which, when actuated, pivots the pawl 19 against the action of the retaining spring 21 to disengage the ratchet wheel 18.

FIGS. 1 and 2 show the safety ski-binding in its normal operating position on the ski. By means of the manner in which the cable of each cable control is guided by being passed over the pulley 16 on the slide latch member 10, the latter is pressed into the catch groove 14 of the fitting 13 at practically twice the force that is imparted to the cable by the spiral spring associated with the cable drum 8. When there is a predetermined large torque load and/or lifting force exerted on the ski boot, the slide latch member 10 is displaced against the action of its locking force and finally disengages from the groove. On further movement of the sole plate 1 relatively to the ski, the pulley 16 serves as no more than a direction-changing roll for the cable and consequently only the lower resistance of the spiral spring opposed movement of the plate during pulling out of the cable 9.

After the force that gave rise to the movement has slackened off or disappeared, the retaining device 18, 19 provided according to the present invention prevents the automatic resetting of the sole plate 1 on the ski 12 or, conversely, pulling up of the ski against the sole plate. This prevents the need during any one fall for releasing the or each latching device two or more times.

To apply the binding to the ski when the skier has come to a halt after a fall, he need merely press the push button 22 of the extended cable control, thereby freeing the cable drum 8 to enable it to wind up the cable 9.

Figures 4, 5, 6:
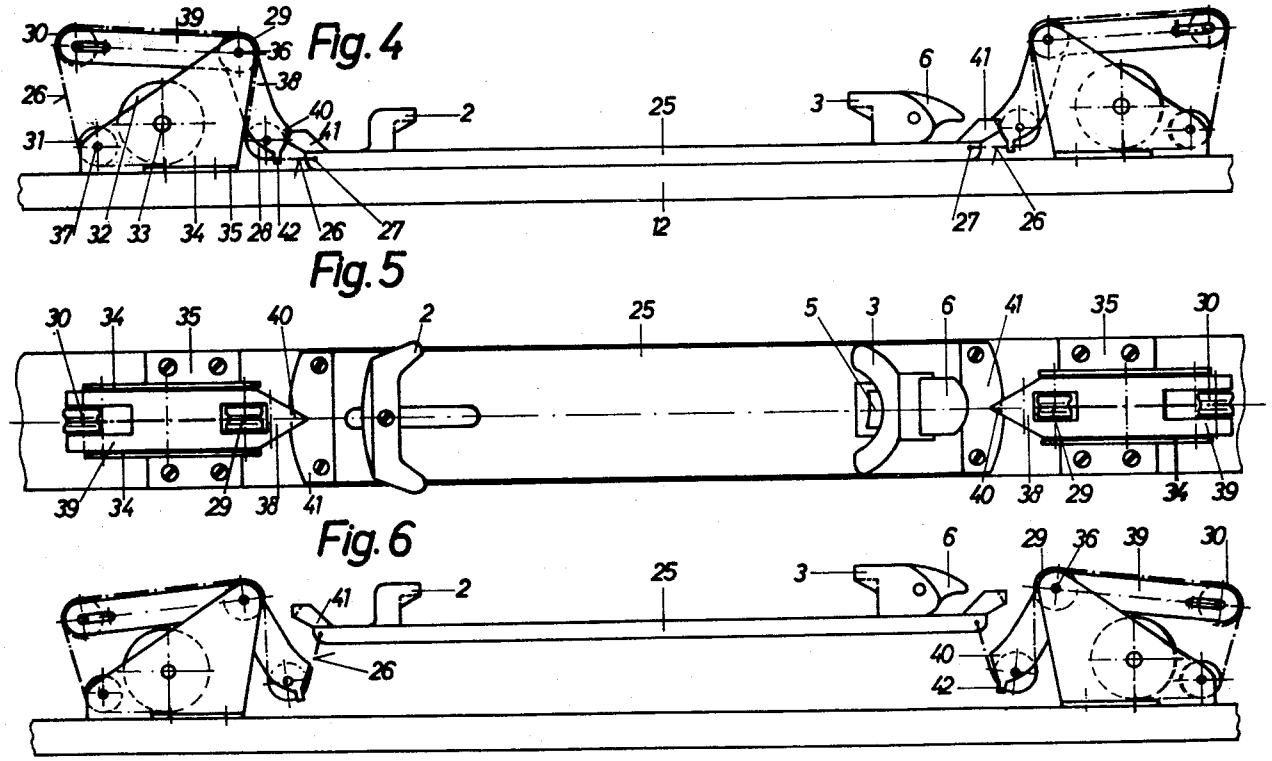
FIG. 4 is a side elevation of a second embodiment of ski-binding.
FIG. 5 is a plan view of the FIG. 4 binding.
FIG. 6 is a side elevation of the binding of FIGS. 4 and 5, wherein the sole plate has been completely released in an upward direction.

The safety ski-binding of FIGS. 4 to 6 is likewise a so-called plate binding. The sole plate 25 again carries the sole holders 2 and 3, of which the latter forms part of a step-in arrangement that can only be deliberately opened. As in the previously described embodiment, a pedal and an opening key are designated 5 and 6, respectively.

Secured to the sole plate 25 at each of the front and back at respective anchoring points 27, there is a cable 26 of a cable control or tackle. Again, the cable controls are mirror images of one another, for which reason only one of them will be described and the same reference numerals have been employed for both.

The cable 26 extends from the anchoring point 27 over pulleys 28, 29, 30 and 31 to a cable drum 32. In the same way as for the cable drum 8 of the embodiment according to FIGS. 1 to 3, a spiral spring (not shown) influences the cable drum 32 in the sense of winding-up the cable 26. The shaft 33 of the drum 32 extends horizontally and transversely with respect to the ski 12 and is mounted in side walls 34 of a frame 35 that is screwed onto the ski. The side walls of the frame also support shafts 36 and 37 for the respective pulleys 29 and 31. The shaft 36 additionally serves as a pivot shaft of a bell crank lever having arms 38 and 39. The pulley 28 is carried at the free end of the shorter lever arm 38 and the pulley 30 is mounted at the free end of the other lever arm 39.

The lever arm 38 serves as a latching lever, its free end being provided with a latching tongue 40 which engages in a catch groove of a fitting 41 provided at the associated end of the sole plate 25. It will be noted that the face of tongue 40 which engages the catch groove of fitting 41 is angled (when in its FIG. 4 position) more vertically than a tangent of a circle centered at the axis of shaft 36. The free end of the lever arm 38 is also provided with a guide member 42 for the cable 26.

The pulley 30 is adjustable along the lever arm 39. This may be effected by a spindle drive (not shown).

Each latching device holds the associated end of the sole plate 25 against upward movement as well as horizontal displacement as long as any force tending to move the sole plate remains below a predetermined value that can safely be withstood by the leg of the skier. The latching lever 38 remains engaged in the catch groove of the fitting 41 under the action of the cable 26.

The normal operating condition of the safety ski-binding is shown in FIGS. 4 and 5. On the occurrence of a high torque and/or lifting force on the ski boot, the latching lever 38 will swing about the shaft 36. When the latching tongue 40 has disengaged the fitting 41, the sole plate 25 is free to move away from the ski against the action of the pull exerted on the cable 26 by the spiral spring of the associated cable drum. To prevent automatic resetting of the sole plate 25 to the ski or, conversely, pulling up of the ski against the sole plate after the force that caused movement of the sole plate has slackened off or disappeared, a pawl and ratchet retaining device may be provided in the same way as for the FIGS. 1 to 3 embodiment. Normally, cable 26, under the action of the spiral spring, tends to hold the tongue 40 in engagement with fitting 41. Lever arms 38 and 39 are loaded in a counterclockwise sense (in the left hand latching mechanism shown in FIG. 4) in attempting to pivot about shaft 36. The loop of cable around pulley 28, at the same time, urges the tongue 40 in the direction of fitting 41. Once the latching device is released (after the exertion of a predetermined threshold force), the tension of the spring on the cable 26 is sufficient to return the sole plate to association with the ski by pulling tongue 40 toward fitting 41.

FIG. 6 shows the sole plate released from both latching devices. Pivotal movement of the latching levers on withdrawal of the sole plate is limited by abutments which, in the present case, are formed by cable drum housings. The releasing force for the latching device is variable by changing the spacing of the pulley 30 from the shaft 36.

Both of the illustrated embodiments show the preferred use of a sole plate 1 or 25. Sole plates have the advantage that they do away with the need for a special ski boot or special attachments for the boot. The FIGS. 1 to 3 embodiment can be modified in that the cable controls are not provided within the sole plate but in front of and behind same in a manner corresponding to the second embodiment. Conversely, the second embodiment of FIGS. 4 to 6 may be modified in that the cable controls are accommodated in the sole plate, the fittings 41 containing the catch grooves then being mounted on the ski.

If however there is no objection to having a special ski boot, the illustrated sole plate 1 or 25 is replaced by the sole of the boot itself. In the case of FIGS. 1 to 3, the sole would therefore accommodate the cable controls. In both embodiments, the fixed cable anchorages such as 17 and 27 would be replaced by deliberately detachable anchorages.

It will be evident that the present invention can be embodied in various constructions. Numerous modifications are possible. The only features essential to the invention are that two latching devices are provided for securing the sole plate or sole of the boot against vertical movement, that each latching device comprises a catch member fixed either to the ski or to the sole plate (or sole of the boot) and a latch member which is movable with respect to the catch member and is mounted on or in the part engaged by the extensible spring-loaded end of the cable control, that the cable control biases the latch member to the latching position, and that the movable latch member carries a pulley over which the cable of each control passes to a fixed anchoring point.

We claim:

1. A safety ski-binding for connecting a ski boot to a ski, the binding comprising: a latching mechanism acting between the boot and the ski for retaining the boot on the ski against relative vertical and horizontal movement under normal operating conditions; said latching mechanism including a housing fixedly mounted relative to one of said boot or ski; biasing pulley means rotatably mounted in said housing; means for biasing said biasing pulley means in one direction; cable means, one end of which is mounted on said biasing pulley and hence is biased therewith; a latch member pivotably mounted on said housing for movement toward and away from the other of said boot or ski; guide pulley means mounted on said latch member for guiding the opposite end of said cable means; a catch member fixed relative to said other of said boot or ski for associating with said latch member and, when so associated, for retaining the boot on the ski against relative vertical movement; connector means for fixing said other end of said cable means relative to said catch member so that said movably mounted latch member is urged toward said catch member as a result of the biasing force exerted on said cable means by said biasing pulley.

2. A safety ski-binding according to claim 1, characterised in that said movably mounted latch member comprises a latching lever.

3. A safety ski-binding according to claim 2, characterised in that said latching lever comprises a bell crank lever having a pair of arms, and a pulley on each of said arms in guiding engagement with said cable.

4. A safety ski-binding according to claim 3, wherein one of said arms has a length greater than the other arm and including means for permitting longitudinal adjustment of the position of the pulley on said one arm.

5. In a releasable ski binding for coupling a ski boot on a ski, the improvement which comprises means for retaining the ski boot on the ski against vertical and horizontal movement, said means including at least one flexible cable between two parts including a member carried by said boot and a member fixed to the ski, one of the ends of the cable being fixed in one of said two parts and at least a partial amount of the other end of said cable being wound on a rotatable member on said other of said two parts, a latching lever pivotably movably mounted on one of said two parts and including means for maintaining said cable in engagement therewith, a catch member mounted on the other of said two parts for releasably engaging said latching lever, and means for biasing said cable into an unextended condition for yieldingly retaining said latch lever in latching engagement with said catch member whereby said cable is movable into an extended condition against the force of said biasing means upon the application of a high vertical force on the boot to permit disengagement of said latch lever from said catch member and release of the boot from the ski.

6. The ski binding according to claim 5, wherein said member carried by said boot is a sole plate detachably connected thereto and said catch member is mounted on said sole plate.

7. The ski binding according to claim 5, wherein said latching lever comprises a bell crank lever having a pair of arms, and a pulley on each of said arms.

* * * * *